US007982758B2

(12) United States Patent
Marcus et al.

(10) Patent No.: US 7,982,758 B2
(45) Date of Patent: Jul. 19, 2011

(54) APPARATUS FOR CONTROLLING PEEL POSITION IN A PRINTER

(75) Inventors: Michael A. Marcus, Honeoye Falls, NY (US); Thomas F. Kaltenbach, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 5 days.

(21) Appl. No.: 12/569,981

(22) Filed: Sep. 30, 2009

(65) Prior Publication Data

US 2011/0074905 A1 Mar. 31, 2011

(51) Int. Cl.
*B41J 2/325* (2006.01)

(52) U.S. Cl. ..... 347/216; 347/215

(58) Field of Classification Search ..... 347/215, 347/216, 217

See application file for complete search history.

(56) References Cited

U.S. PATENT DOCUMENTS

| | | | | |
|---|---|---|---|---|
| 4,928,141 | A | | 5/1990 | Poehlein et al. |
| 5,117,241 | A | | 5/1992 | Stephenson |
| 5,294,203 | A | * | 3/1994 | Williams ..... 400/234 |
| 5,342,131 | A | * | 8/1994 | Nakajima et al. ..... 400/120.01 |
| 5,534,909 | A | * | 7/1996 | Hanabusa et al. ..... 347/216 |
| 6,201,255 | B1 | | 3/2001 | Torchalski et al. |
| 6,315,471 | B1 | | 11/2001 | Hsieh et al. |
| 6,326,991 | B1 | * | 12/2001 | Kinjyo et al. ..... 347/216 |
| 6,474,886 | B1 | | 11/2002 | Sugiyama et al. |
| 6,778,277 | B2 | | 8/2004 | Marcus et al. |
| 6,929,342 | B2 | | 8/2005 | Claramunt et al. |

FOREIGN PATENT DOCUMENTS

| | | | | |
|---|---|---|---|---|
| JP | 1-130963 | * | 5/1989 | ..... 347/216 |

* cited by examiner

*Primary Examiner* — Huan H Tran
(74) *Attorney, Agent, or Firm* — Eugene I. Shkurko

(57) ABSTRACT

An electromechanical system and a printer for maintaining a peel location of media impressed on a receiving substrate. A mounted optical probe has at least one light source and one or more photodetectors for detecting reflected portions of the light emitted or transmitted from the light source. The photodetector indicates to the system controller a distance of the media for controlling a peel location via an electrical signal. A comparator compares the electrical signal with a predetermined electrical signal reference to determine if the media is desirably positioned. The predetermined electrical reference signal corresponds to the desired peel location. The comparator compares the signal levels and outputs a correction signal used in a negative feedback loop for adjusting a velocity of a motor that drives a take-up roller for the media.

19 Claims, 10 Drawing Sheets

APPARATUS FOR CONTROLLING PEEL POSITION IN A PRINTER

CROSS REFERENCE TO RELATED APPLICATION

Reference is made to commonly assigned, co-pending U.S. patent application Ser. No. 12/569,964 by Marcus et al. filed of even date herewith entitled "Method For Controlling Peel Position In A Printer", the disclosure of which is incorporated herein by reference in its entirety.

FIELD OF THE INVENTION

The present invention relates to measurement methods and apparatuses, and more particularly to a method and apparatus to maintain a desired peel location of a first web from a second web located in a printer.

BACKGROUND OF THE INVENTION

A typical multi-color dye donor web that is used in a dye transfer or thermal printer has a repeating series of three different rectangular-shaped color sections or patches such as a yellow color section, a magenta color section and a cyan color section. In addition, there may be a transparent colorless laminating section immediately after the color sections.

Each color section of the dye donor web consists of a dye transfer area which is used for dye transfer printing and a pair of opposite longitudinal edge areas alongside the dye transfer area which are often not used for printing. The dye transfer area may be about 152 mm wide and the two longitudinal edge areas may each be about 5.5 mm wide, so that the total web width is approximately 163 mm.

To make a multi-color image print using a thermal printer, a motorized donor web take-up spool draws a longitudinal portion of the dye donor web off a donor web supply spool in order to successively move an unused single series of yellow, magenta and cyan color sections over a stationary liner array (bead) of selectively heated resistive elements on a thermal print head between the supply and take-up spools. Respective color dyes within the yellow, magenta and cyan color sections are successively heat-transferred line-by-line, via the selectively heated resistive elements, onto a dye receiver medium such as a paper or transparency sheet or roll, to form the color image print. The selectively heated resistive elements often extend across the entire width of a color section, i.e. across the dye transfer area and the two longitudinal edge areas comprising that color section.

As each color section is drawn over the selectively heated resistive elements, it is subjected to a longitudinal tension particularly by the forward pulling force of the motorized donor web take-up spool. Since, the dye transfer area in the color section is heated by the resistive elements the web is weakened, making the web vulnerable to being longitudinally stretched if too much tension is applied. Consequently, too much longitudinal tension will stretch the donor web in the dye transfer area which in turn causes some creases or wrinkles to develop in the dye transfer area. As the dye donor web is pulled by the motorized donor web take-up spool over the selectively heated resistive elements, the creases or wrinkles tend to spread from a trailing (rear) end portion of a used dye transfer area at least to a leading (front) end portion of the next dye transfer area to be used. The line artifacts printed on the dye receiver medium, although they may be relatively short, are quite visible. This indicates that too much tension on the dye donor web will result in creases or wrinkles being created in an unused dye transfer area and line artifacts being printed on the dye receiver medium during the dye transfer process.

More significantly, as each color section is drawn over the selectively heated resistive elements too little tension will cause the web to be slack. Decreasing the tension further will cause more slackness in the web. This will result in improper peeling or delamination of the dye donor web from the receiver web. Improper peeling ranges from the peel position of the web shifting from the desired location at the peel bar to the extreme of not delaminating at all and causing a printer jam. When the peel location of the dye donor web is not at its desired location there is a high probability for defects to occur in the printed image. These defects include spot defects, creases, sticking defects and streaks. Many of these defects are due to the fact that the donor web will selectively stick to the receiver web at specific locations if there is not enough web tension to maintain the peel location. Spot defects are regions of low and high print density caused by micro folds in the donor sheet due to too little tension in the donor web. Sticking defects are due to the detachment of the dye layer in a thermal donor from the PET (polyethylene terephthalate) support and transfer of the dye layer to the receiver during the peel process following printing. This is a serious and unacceptable problem for the customer because it results in high density dye specs being scattered across the face of the receiver.

Thus, there is a need to maintain a desired peel location of a first web from a second web in thermal printers. The first web is usually a donor media ("dye donor web") containing the colorants that are thermally transferred to the receiver media (second web). The receiver media is usually the final hardcopy print. The transfer process needs to be carefully controlled so that the correct amount of colorant(s) is transferred to produce a high quality image on the receiver material. During the printing process the two webs are brought in contact at the print head where thermal lamination occurs during the dye transfer process. After lamination, the two webs must be separated from each other in a controlled fashion. This separation is achieved by applying a known force to the laminated layers at a fixed location known as the peel location. This force is usually applied by tensioning the webs and forcing the webs to travel in different directions as they pass the desired peel location. The desired peel location is at a peel bar. If the force applied to the webs is insufficient then the webs will not separate at the desired peel location. When this occurs the quality of the print can be adversely affected and in severe cases the webs stay laminated together and cause the printer to jam. If the force applied to the web is too large then the webs may deform and introduce printing artifacts.

Different donor and receiver materials will have different binding forces when thermally laminated together and will therefore require different levels of separation force in order to ensure separation at the desired peel location in a thermal printer. Furthermore changing environmental conditions such as ambient temperature and humidity can also cause the binding forces to change for a given set of donor and receiver webs. Product variability resulting from material variations can also affect the binding forces. All sources of variation in the binding forces between a pair of donor and receiver webs will require different levels of separation force in order to ensure separation at the desired peel location in a thermal printer.

U.S. Pat. No. 6,315,471 by C. Hsieh and C. Chung entitled "Apparatus for Controlling Ribbon Tension in a Thermal Printer" describes an apparatus and method for controlling the tension on the web by pulse width modulation (duty cycle control) by monitoring the input and output diameters of the web on the supply and take-up reels and setting up a transforming table for varying the pulse width modulation as a function of web diameters to keep uniform tension on the ribbons (web).

U.S. Pat. No. 6,082,914 by G. Barrus and K. Moore entitled "Thermal Printer and Drive System for Controlling Print Ribbon Velocity and Tension" describes a thermal printer having a supply of media with a rotatable platen on which the media is moved for printing by a thermal printing head. A supply spindle supplies print ribbon from a supply spool mounted thereon, and a take-up spindle takes up the used print ribbon on a take-up spool. The spindles are each driven by a motor and controlled by a controller which detects the Back EMF (BEMF) of the motors, and calculates the velocity of the spindles, spool, and print ribbon to control each motor based on the BEMF.

Commonly assigned U.S. Pat. No. 6,859,221 by Z. J. Gao, R. F. Mindler and J. F. Corman entitled "Preventing Crease Formation In Donor Web In Dye Transfer Printer That Can Cause Line Artifact On Print" describes a method of preventing crease formation in a dye transfer area of a dye donor web that can cause a line artifact to be printed on a dye receiver during a dye transfer from the dye transfer area to the dye receiver in a dye transfer printer by controlling the heat distribution over the dye transfer area.

Commonly assigned U.S. Pat. No. 6,977,669 by Po-Jen Shih et al. entitled "Preventing Crease Formation in Donor Web in Dye Transfer Printer That Can Cause Line Artifact On Print" describes a thermal printer which employs the method described in commonly assigned U.S. Pat. No. 6,859,221.

U.S. Pat. No. 6,922,205 entitled "Color Thermal Printer And Color Thermal Printing Method" by M. Shusuke describes a thermal printer which conveys a recording sheet at a certain speed by keeping tension applied to a conveyor roller pair within a range designed not to influence the conveyance speed.

None of the prior art can ensure that the location of the peel location is correct and that the thermal printer is working at its designed print resolution. Thus there is a need for a thermal printer that includes a sensor system which can determine the actual peel location of the first web and the second web and to adjust the web tensions so that the peel location will be maintained at the desired peel location within desired tolerance limits for various combinations of thermal web media. Such a thermal printer will tolerate broader variations in manufacturing of the media which affect the tension requirements. Thus, the media may not need to have as tight manufacturing tolerances which would lead to less waste in media manufacturing. This thermal printer will also be able to accommodate for changing environmental conditions which change the peel force and will also result in decreased incidence of machine jams. With such a sensor system installed in a thermal printer, the web tension for new web materials can be automatically adjusted to enable for use in an existing printer.

SUMMARY OF THE INVENTION

The need is met according to the present invention by providing a method for maintaining a peel location for peeling a first web from a second web in a thermal printer. A preferred embodiment of the present invention comprises an electromechanical system handling two webs for maintaining a peel location of the webs. The electromechanical system includes a mounted optical probe having at least one light source and one or more photodetectors for detecting reflected portions of the light emitted or transmitted from the light source. The photodetector outputs an electrical signal depending on the amount of detected reflected light which indicates to a system controller how far away from the detector a reflecting surface is located. In a preferred embodiment the reflecting surface is one of the aforementioned webs. The desired peel location corresponds to a desired location of one of the webs as detected by the photodetector. Hence, the photodetector detects the amount of reflected light and sends a corresponding electrical signal to the system controller, in particular a comparator portion of the controller, which determines if the reflected light intensity corresponds to a desired location of one of the webs. The comparator compares the electrical signal, such as its magnitude, with a predetermined electrical signal reference characteristic to determine if the current web position is at the desired point. The predetermined electrical reference signal corresponds to the desired peel location. The comparator compares the signal levels and outputs a correction signal used in a negative feedback loop for adjusting a velocity of a motor that drives a take-up roller for one of the webs. By increasing or decreasing the velocity of the motor the web is taken up more quickly or more slowly, respectively. This controls the position of the web and, correspondingly, the peel location. When the motor velocity is decreased the web exhibits increased slack and when the motor velocity increases the slack in the web is taken up. In this instance, the term slack refers to the web peel location being located further from a preferred peel location.

Another preferred embodiment of the present invention includes a thermal printer comprising thermal media traveling through the thermal printer under control of rotating media rollers. The rotating media rollers can be guide rollers, pinch rollers, take-up rollers, feed rollers, supply rollers, or any other sort of media handling rollers. Some of these rollers can control a slack of the media as it travels through the printer, usually through the use of a drive motor that controllably rotates the rollers. The faster a drive motor rotates a particular roller the less the slack in the media. The speed of the drive motor is controlled by a voltage controller coupled to the motor. In turn, the voltage controller is coupled to an output of a photodetector that monitors a distance between the media and the photodetector. The output of the photodetector is a signal indicating an excess of the slack in the media for enabling the drive motor, via a correction signal from the controller to increase the speed of rotation of at least one of the media rollers for reducing the slack. The detector comprises a light source and at least one photodetector, the detector is positioned to shine light onto the media and to detect an amount of light reflected from the media. A circuit coupled to the detector outputs the signal indicating the excess of the slack in response to the detected amount of light reflected from the media.

Another preferred embodiment of the present invention comprises a printer with a number of media rollers for controllably moving media through the printer. As explained above, one of the media rollers has media rolled on it, a second one of the media rollers is for taking up used media, and a third one is for guiding the media. Other rollers can also be used. A receiving sheet is also presented, by rollers designed for handling such substrates, that will receive a portion of the media by adhering the media to the receiver via heat transfer using a print head. A peel bar, together with a take-up roller, then peels remaining media from the receiver at a peel location near the end of the peel bar. A photodetector, as explained above controls the peel location by insuring the used media does not get too close to the photodetector because that proximity indicates that the peel location has migrated too far from an ideal location.

The present invention enables the design of improved thermal printers which provide improved performance in providing less printer defects and decreased incidence of machine jams. Furthermore the printer better accommodates for changing environmental conditions which change the peel force and better tolerates variations in manufacturing of the media which affect the tension requirements.

These, and other, aspects and objects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications. The figures below are not intended to be drawn to any precise scale with respect to size, angular relationship, or relative position.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to methods and/or elements forming part of, or cooperating more directly with, apparatus in accordance with the present invention. It is to be understood that elements not specifically shown or described may take various forms well known to those skilled in the art.

Figure 1:
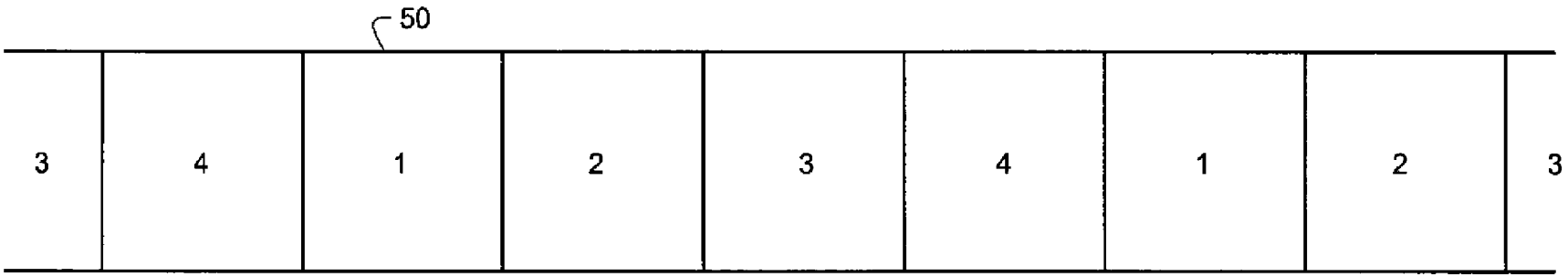
FIG. 1 is plan view of a typical dye donor web including successive dye transfer areas.

FIG. 1 depicts a typical multi-color dye donor web or ink ribbon 50 that is used in a dye transfer or thermal printer apparatus and method. The dye donor web 50 has a repeating series (only one completely shown) of three different rectangular-shaped color sections or patches such as a first color section 1 (usually yellow), a second color section 2 (usually magenta) and a third color section 3 (usually cyan). In addition, there is usually a transparent overcoat section or patch 4 (laminate) immediately after the third color section 3. The repeating series of dye donor web sections is applied to the same area of a second web or receiver sheet 110 shown in FIG. 2.

Figure 2:
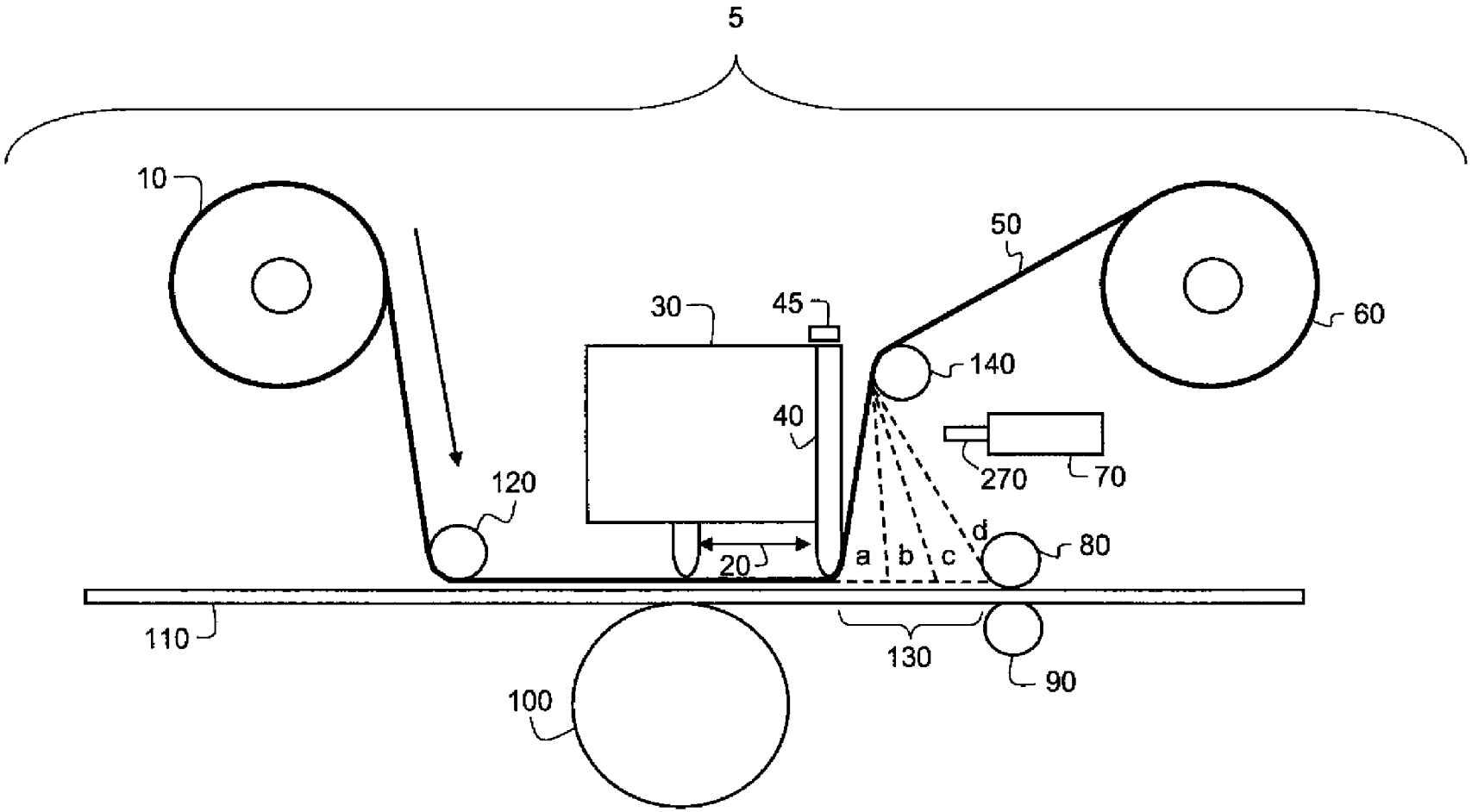
FIG. 2 shows an overview schematic of a thermal printer according to one aspect of this invention.

FIG. 2 shows an overview schematic of a thermal printer 5 according to one preferred embodiment of this invention. A first web or dye donor web supply spool 10 is used to deliver a first web or dye donor web 50 past a guide roller 120 to a print head 30. A second web or dye receiver sheet 110 gets thermally laminated to the first web 50 at the location at which the print head 30 and platen roller 100 come in close proximity while heat is applied to the print head 30. It is desired for the webs to remain laminated over the print head to peel plate lamination distance 20 which terminates at the peel bar 40. After passing peel bar 40 the dye donor web 50 passes peel guide roller 140 and is wound up on motorized donor web take-up spool 60. Location 130*a* is the desired peel location of donor web 50 from receiver sheet 110. If the tension on the donor web 50 is lower than desired the peel location may move to location 130*b*. As the tension gets successively lower on donor web 50 the peel location will move to position 130*c*, and at still lower tension on donor web 50 the donor web 50 will get caught between motorized capstan roller 80 and pinch roller 90 as indicated by position 130*d*.

The peel bar 40 may also include an optional load cell 45 which is used to measure the tension of the donor web 50 as it passes over the contact region with the peel bar 40. The purpose of peel bar web tension measuring load cell 45 is to keep the tension of the donor web within the safe level tension so that defects due to too much tension on the donor web 50 do not occur. This safe level tension is determined during initial printer set up. Too much tension on the donor web 50 causes an upward pressure on the peel bar 40 which is detected by the peel bar web tension measuring load cell 45. Adjustment is then made to the speed of donor web take-up spool 60.

During the printing process the receiver sheet 110 is driven forward by motorized capstan roller 80 and pinch roller 90 to the beginning of the first section 1 or patch of donor web 50. The print head 30 is then lowered to make good thermal contact with donor web 50 and receiver sheet 110 over platen roller 100. The donor web 50 and the receiver sheet 110 are then both transported at the same velocity while heat is applied to the webs by the print head 30. When the printing of the first section 1 of donor web 50 is completed, by heat induced transfer of the donor web onto the receiver sheet 110 (the print), the webs are stopped and the print head 30 is raised. The receiver sheet 110 is then driven backward by motorized capstan roller 80 and pinch roller 90 to align the start of the printed region on the receiver sheet 110 with the beginning of the second section 2 of donor web 50. The print head 30 is then lowered to make good thermal contact with donor web 50 and receiver sheet 110 over platen roller 100. The donor web 50 and the receiver sheet 110 are then both transported at the same velocity while heat is applied to the webs by the print head 30. When the printing of the second section 2 of donor web 50 is completed the webs are stopped and the print head 30 is raised. This process is repeated to transfer donor sections 3 and 4 to receiver sheet 110. After printing section 4 of the donor web the print head 30 is raised and the print exits the printer. Not shown in FIG. 2 are electrical connections and drive motors that are coupled to the motorized rollers, spools, etc., and for raising print head 30. Although not all rollers shown in the figure are described as motorized, any of them can be so modified. Also not shown is a system controller that monitors and adjusts performance of all parts of the print system shown in FIG. 2. All these unillustrated components are well known to those skilled in the art.

An optical probe 70 which measures the distance of a web from the probe tip is installed in the printer with probe tip 270 facing the web. The optical probe 70 comprises a light source which transmits light to the web. Light is reflected from the web and the reflected light is incident on at least a pair of optical sensors which have different signal profiles as a function of the distance between the web and the sensors. The ratio of the two optical sensor signals is obtained, as explained below, and the ratio is dependent upon the distance from the web to the sensors. With an accurate measurement of the distance, i.e. at one of the peel locations 130, the tension in the web can be adjusted so that the web can be brought back to the appropriate distance for the product. For example, a distance detected by the sensors may indicate that the donor web 50 is at position c or d (of FIG. 2) and must be brought back to a preferred position at about a. The position of donor web 50 is controlled by adjusting the rotation speed, and therefore the tension, on donor web take-up spool 60.

Figure 3B:
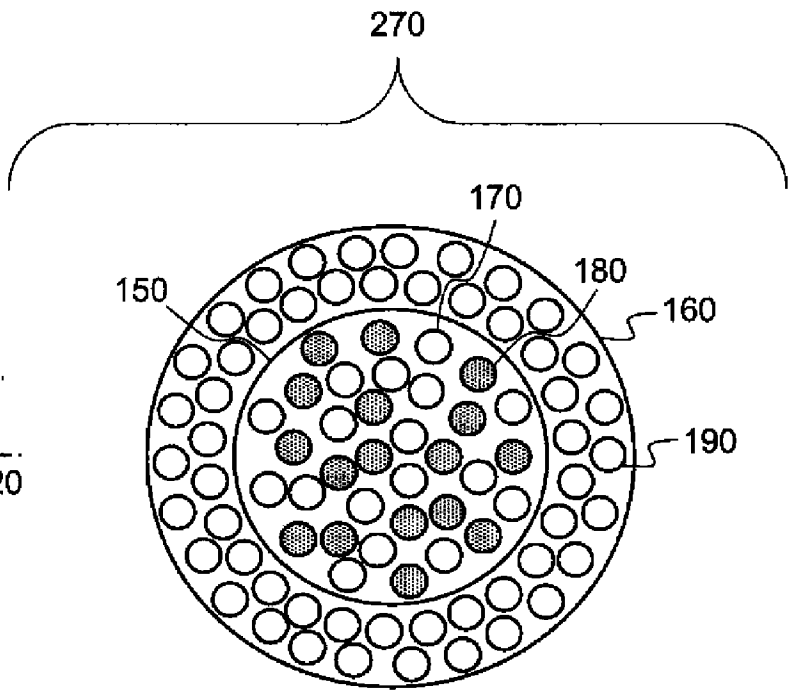
FIG. 3B shows the output end of an optical fiber probe according to one embodiment of this invention.
Figure 3A:
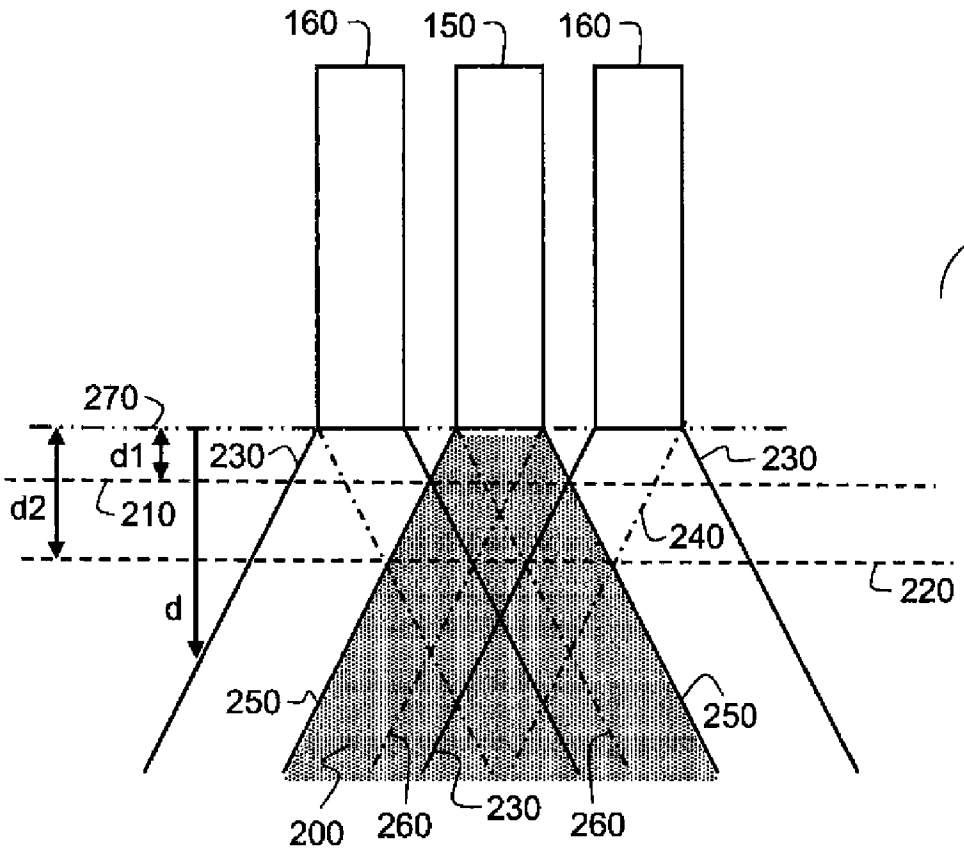
FIG. 3A shows the illumination and detection regions extending from the output end of an optical fiber probe according to one embodiment of this invention.
Figure 3C:
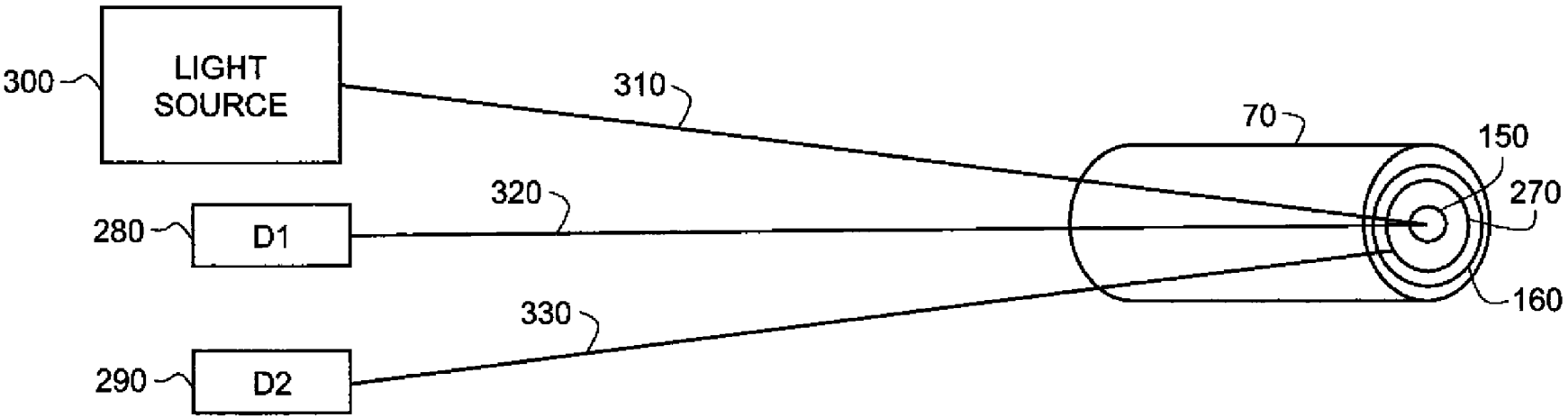
FIG. 3C shows the illumination and detection path of the optical fiber probe according to one embodiment of this invention.

Details of an optical probe 70 embodiment are illustrated in FIG. 3A, FIG. 3B and FIG. 3C respectively. Commonly assigned U.S. Pat. No. 6,778,277, entitled "Apparatus And Method To Measure Film Motion In A Film Gate" by M. Marcus describes the principles of calibrating a reflective photonic probe, the disclosure of which is hereby incorporated by reference in its entirety.

FIG. 3A shows the illumination and detection regions extending from the probe tip of an optical fiber probe according to a preferred embodiment of this invention. FIG. 3B shows the probe tip 270 of an optical fiber probe 70 according to a preferred embodiment of this invention. The probe tip 270 is the light output end of the optical probe 70. FIG. 3C shows the illumination and detection path of the optical fiber probe according to a preferred embodiment of this invention. The optical probe tip 270 of the fiber optic probe 70 consists of an inner optical probe bundle 150 and an outer optical probe bundle 160. The inner optical probe bundle 150 is composed of multiple illumination optical fibers 180 and multiple inner detection optical fibers 170 randomly bundled together. The outer optical probe bundle 160 is comprised of multiple outer detection optical fibers 190. As shown in FIG. 3C the illumination fibers 180 in inner optical probe bundle 150 are coupled to light source 300 through optical fiber bundle 310. As shown in FIG. 3C the inner detection optical fibers 170 in inner optical probe bundle 150 are coupled to photodetector (D1) 280 through optical fiber bundle 320. Similarly the outer detection optical fibers 190 of outer optical probe bundle 160 are coupled to photodetector (D2) 290 through optical fiber bundle 330. Signal conditioning electronics (not shown in FIG. 3C) are used to convert the electrical signal levels detected at photodetectors (D1) 280 and (D2) 290 indicative of the optical signal levels to electrical output signal levels indicative of a distance of web 50 from the optical probe tip 270.

FIG. 3A shows the illumination cone of light 200 being transmitted from the illumination optical fibers 180 as a function of distance d from the optical probe tip 270. The illumination optical fibers 180 are illuminated with light source 300 typically in the NIR (near infra red) region of the spectrum. The outer detection optical fibers 190 are combined in optical fiber bundle 330 and the light passing through them is detected by photodetector (D2) 290. The inner detection optical fibers 170 are also combined in optical fiber bundle 320 and light passing through them is detected by photodetector (D1) 280. The illumination cone 200 of the inner optical probe bundle 150 is defined by the numerical aperture (NA) of the fibers making up the bundle with the maximum angles of illumination being indicated by illumination cone edge indicators 250. The edge of the (detection cone) NA of the outer optical fiber bundle 160 is indicated by outer fiber bundle NA edge indicator 230. In order for light to be incident on the first or second photodetector light must be reflected from a reflective surface facing the output end of the optical fiber probe 270 and be incident on the fibers at angles within the overlap of the cones defined by the NA of the illumination optical fibers 180 and the detection optical fibers 190. In the configuration shown in FIG. 2 the reflective surface is the donor web 50. The NA of the outer fiber bundle fibers 190 limits the size of the overlap region between illumination fiber and the reflected light that can be coupled into the outer fiber bundle 160 and transmitted through optical fiber bundle 330 to photodetector (D2) 290. Dashed line 240 indicates the edge of the light reflecting off of the donor web 50 which can be transmitted to photodetector (D2) 290. Similarly dashed line 260 indicates the edge of the illumination light which can be reflected into outer detection fiber bundle 160.

As shown in FIG. 3A first distance plane 210 is located at distance d1 from the optical probe output end 270 and second distance plane 220 is located at distance d2 from the optical probe output end 270. At distances d less than d1 no light illuminating donor web 50 from illumination optical fibers 180 will be transmitted down outer detection optical fiber to photodetector (D2) 290. This is because there is no overlap of the illumination cone of illumination optical fibers 180 with the acceptance aperture, or detection cone, defined by the NA of optical fibers 190. At distances between d1 and d2 the detected signal at photodetector (D2) 290 will increase monotonically as the distance between the optical probe output end 270 and the donor web 50 increases until a maximum is reached at distance d2. See FIG. 4 for a graph of detected signal magnitudes. This is because the overlap area between the illumination cone of optical fibers 180 and the acceptance cone defined by the NA of optical fibers 190 is growing faster than the illumination cone of optical fibers 180 in this region. Beyond the distance d2 the detected optical signal will decrease as a function of distance d, because the overlap area of the illumination cone of optical fibers 180 and the acceptance cone of optical fibers 190 remains constant in this region while the illuminated plane area continues to increase as a function of distance from the front surface of the optical probe 70. As the illuminated plane area increases the amount of light per unit area on that plane decreases. Thus, when the overlap area remains constant as a function of increasing distance in this region the detected signal at the photodetector will decrease with increasing distance.

Figure 4:
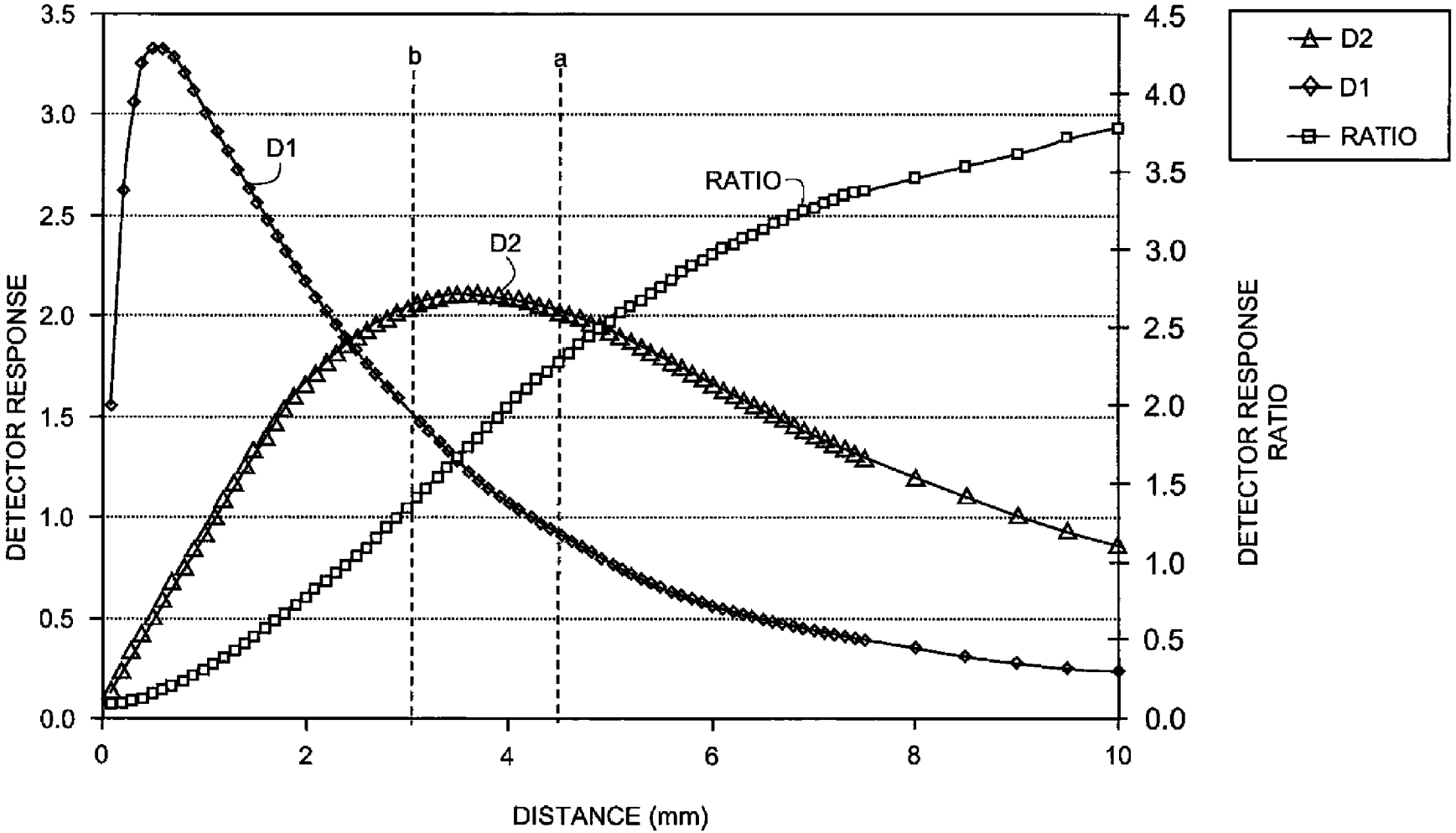
FIG. 4 shows the detector response and the detector response ratio as a function of distance from a probe of the type shown in FIG. 3.

FIG. 4 shows a detector response for photodetector (D1) 280 and photodetector (D2) 290 and the detector response ratio as a function of distance from the output end 270 of an optical fiber probe 70 of the type shown in FIG. 3A, FIG. 3B and FIG. 3C. The detector response is equivalent to the electrical output signal level, i.e. the voltage level, of the detector. Since the center to center spacing of the inner illumination fibers 180 and the inner detection fibers 170 is much closer than that between the inner illumination fibers 180 and the outer detection fibers 190 the detector response curve for photodetector (D1) 280 will reach a maximum at a much shorter distance from the probe surface than that for photodetector (D2) 290. The amplitude of the two detector response functions D1 and D2 are dependent on the reflectivity of the dye donor web 50 which may vary for different patches 1-4 of the dye donor web 50. The ratio of the 2 detector response functions also shown in FIG. 4 is found to be independent of this reflectivity and is purely a function of distance of the dye donor web 50 from the output end 270 of the fiber optic probe 70. The optical probe response function data shown in FIG. 4 was obtained with an optical probe composed of 3.5 mil outer diameter optical fibers with NA=0.25. The diameter of the inner bundle 150 was 46 mil and the outer detection optical fibers were arranged in a ring with a diameter of 93 mil diameter. Distances labeled a and b in FIG. 4 and FIG. 7 correspond to locations a and b in FIG. 2.

In cases where the reflectivity of the web 50 is relatively constant as measured from patch to patch, it is not necessary to use a plurality of photodetectors in the optical probe 70. In this case a single photodetector can be used and its electrical output signal, such as that for photodetector D1 in FIG. 4 can be used for control of peel location.

Figure 5:
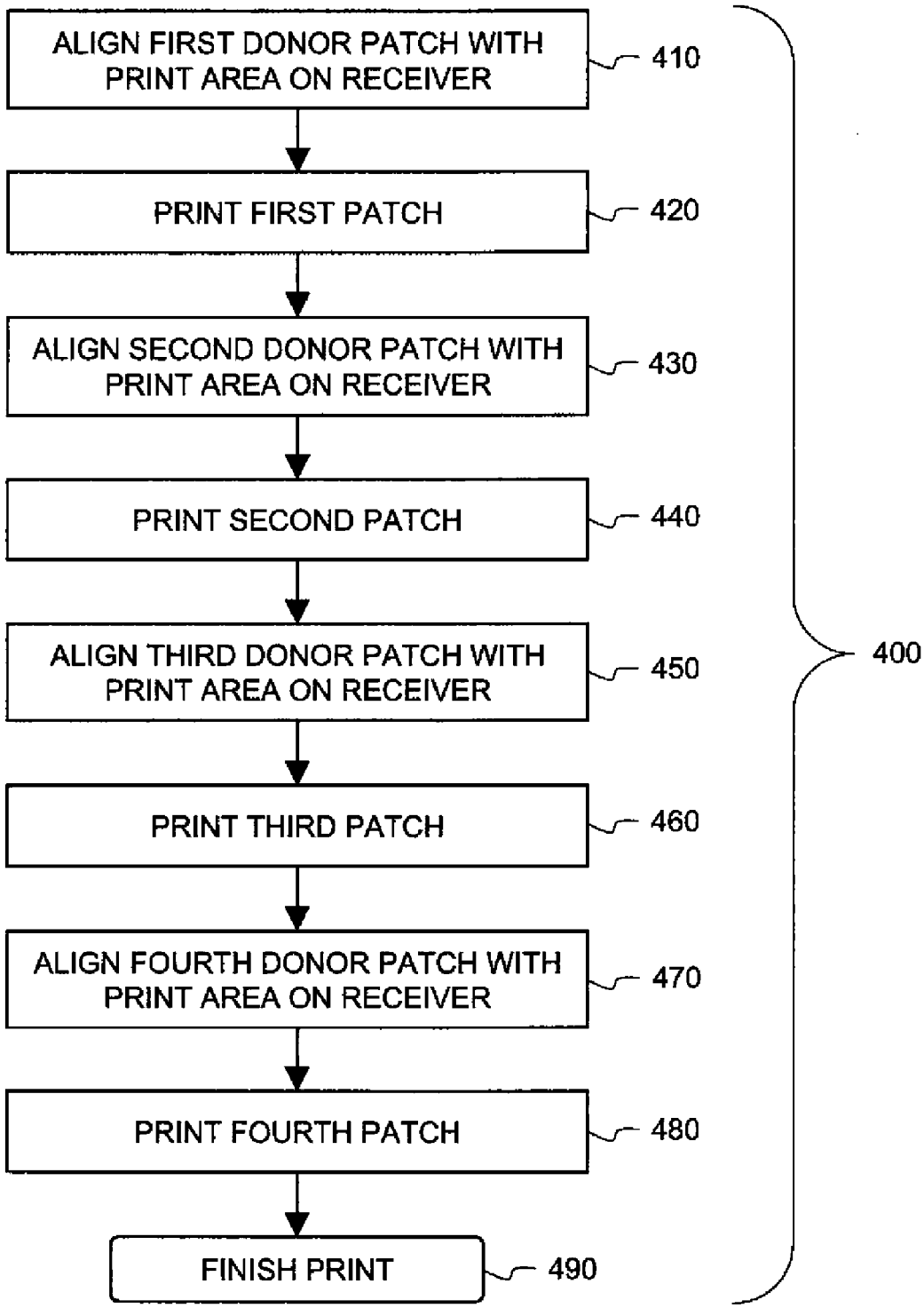
FIG. 5 shows a flow chart of the page printing process.

A flow chart of the page printing process 400, as described above, is briefly illustrated in FIG. 5. At the beginning of the printing process, the first web 50 and second web 110 are brought in contact with each other and the first donor patch or section 1 on the first web 50 is aligned with corresponding print area on the receiver or second web 110 in Step 410. After alignment, the print head is lowered and the first donor patch or section 1 is printed in Step 420. The print head is then raised and the donor web 50 is peeled and advanced to the second patch or section 2, and the receiver 110 is translated back to realign the print area with the second donor patch or section 2 in Step 430. The second patch is then printed in Step 440 in the same manner as the first patch. The process repeats similarly to align and print the third and fourth patches on the print area of the receiver in Steps 450-480. The printing process completes with Step 490. After the fourth patch or section 4 is printed the print (receiver) is advanced and ejected from the printer. In the above embodiment of this invention, an optical probe 70 is mounted in a thermal printer 5 to monitor the donor web position 130 near the peel bar 40. The position of the donor web 50 is determined by monitoring the electrical level of the ratio of the probe signals as shown in FIG. 4. This ratio is proportional to the distance between the optical probe 70 and the donor web 50. By monitoring this ratio, variations in the donor web position 130 can be detected.

Figure 6:
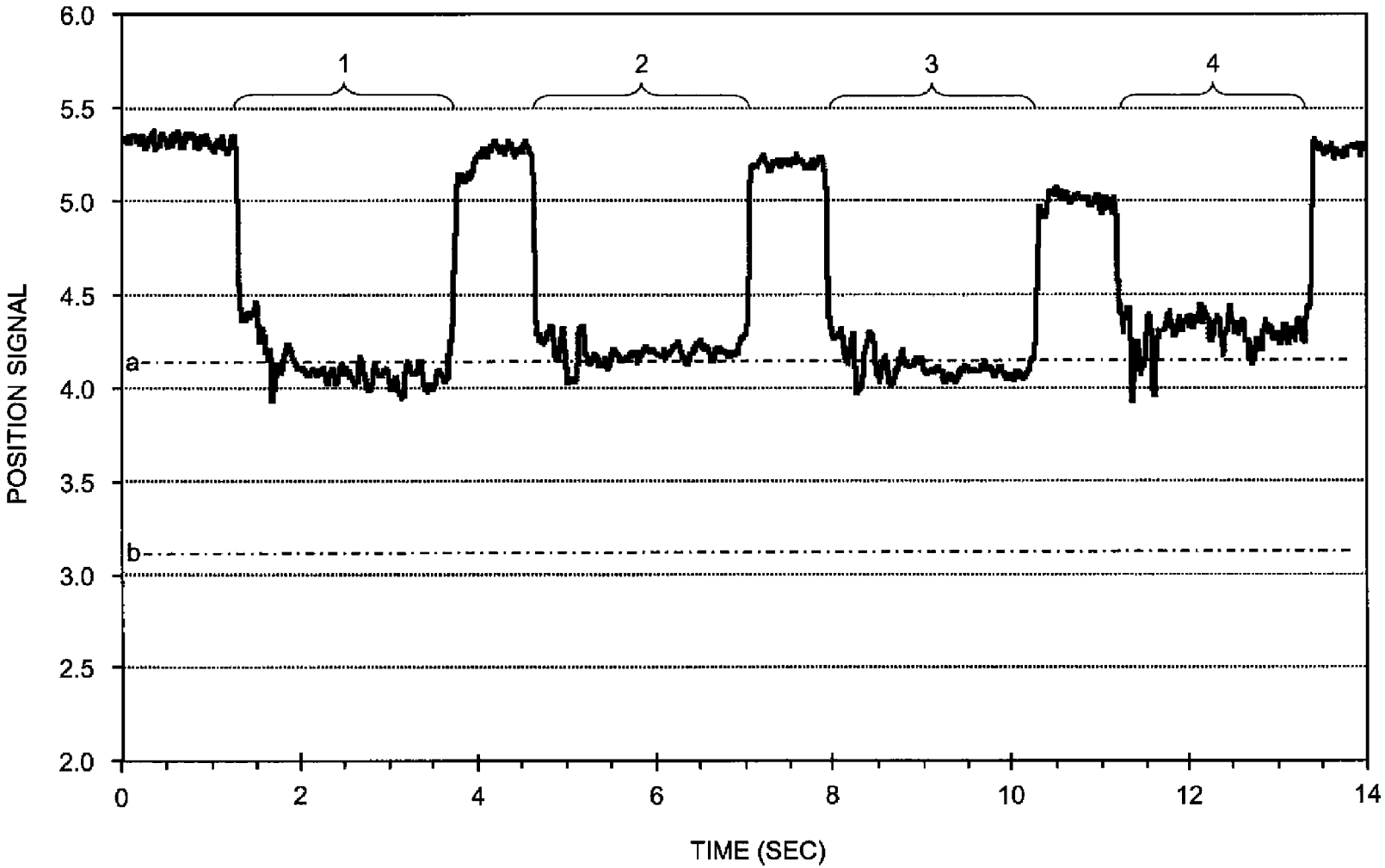
FIG. 6 shows an example sensor response ratio of a thermal web during printing of sequential donor patches under appropriate tension conditions.

The repetitively measured ratio of the electrical output signal levels as a function of time during printing of four patches using normal print conditions is shown graphically in the plot in FIG. 6. The time period during which the first donor patch is printed is labeled 1. The time periods for the printing of donor patches 2-4 are labeled with their corresponding numbers. The plot shows that the donor web position 130 during the printing of a patch is relatively constant with some variability around that position. The statistical mean of the measured ratio data values within a patch represents the average web position under normal printing conditions. Position signals labeled a and b in FIG. 6 correspond to locations a and b in FIG. 2. Position signal a is an example of a reference signal, which we define as the measured probe signal for a web when measured at its desired peel location. In between the printing periods a magnitude of the position signal increases as the tension changes during print alignment.

Figure 7:
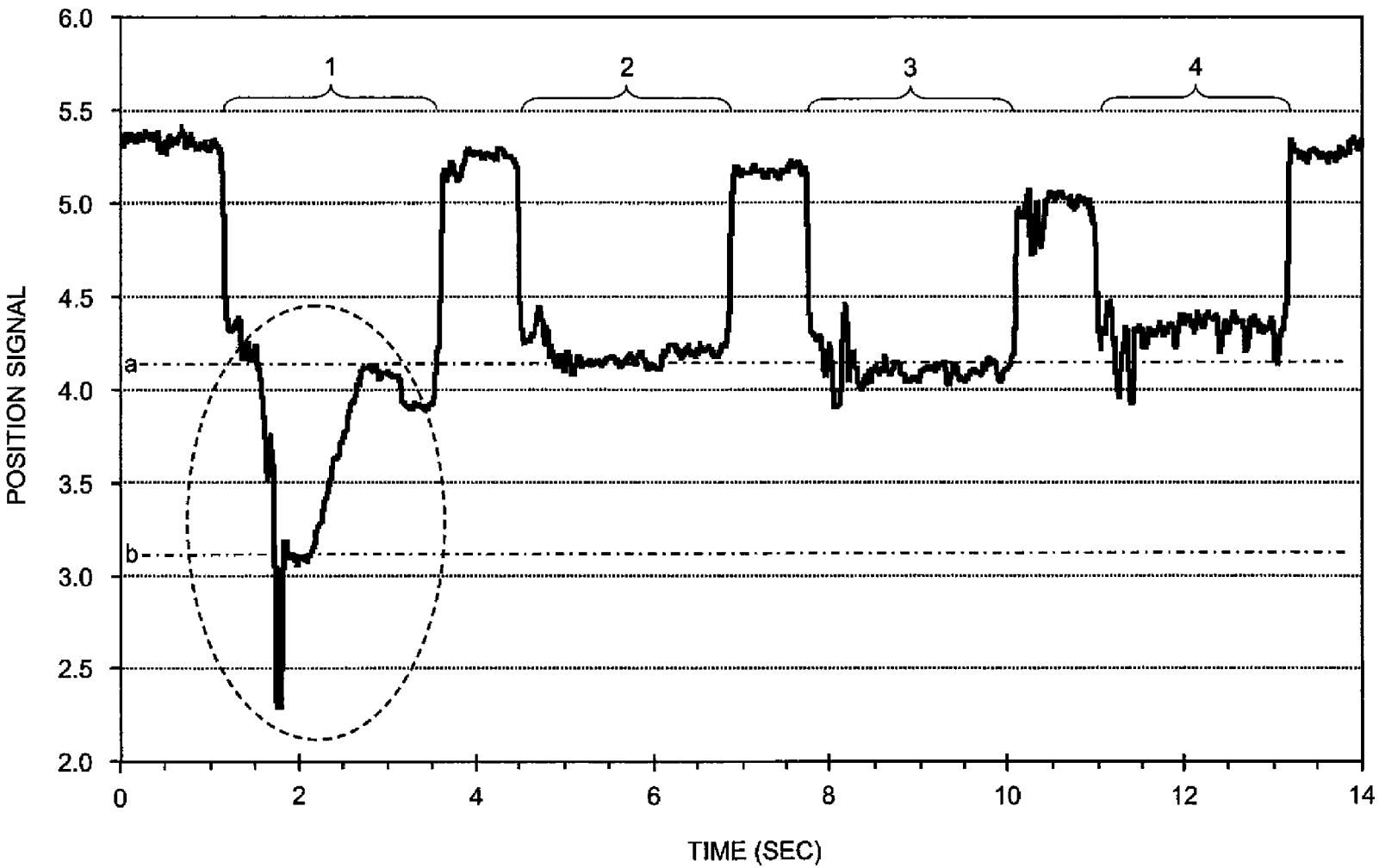
FIG. 7 shows an example sensor response ratio of a thermal web during printing of sequential donor patches under inappropriate tension conditions.

FIG. 7 shows data collected when the web tension was deliberately decreased during printing. Position signals labeled a and b in FIG. 7 correspond to locations a and b in FIG. 2. The data within the first patch shows that the position has deviated from the normal position. This deviation is denoted with an oval dashed line in FIG. 7. The deviation occurs during the first half of the patch printing duration, and then the position is observed to return to normal during the second half of the patch printing duration. If the tension is lowered further, greater deviations may occur. The shift in the measured position for the first patch indicates that the applied web tension was insufficient to peel the webs apart at the desired location, while the data for the subsequent patches implies that the tension was sufficient for those patches. This exemplifies the characteristic that different combinations of donor and receiver materials will require differing amounts of force to peel them apart. Consequently, measuring and monitoring the peel position can be used to detect abnormal printing situations, whether they arise from differing media combinations or changing printing conditions including mechanical or environmental conditions such as ambient temperature and humidity.

Figure 8:
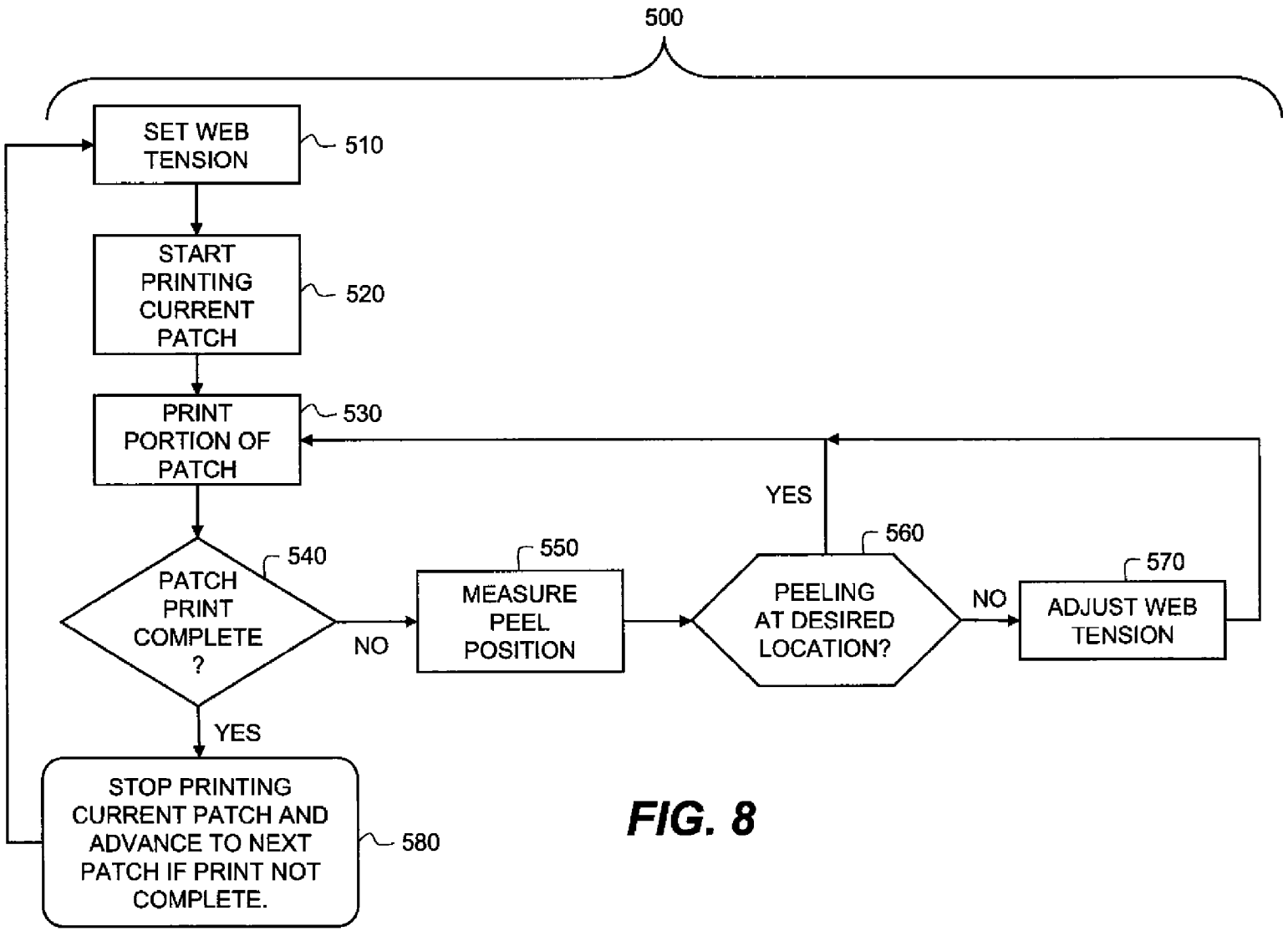
FIG. 8 shows a flow chart of a process for controlling the peel location position during the printing of a donor patch in accordance with an embodiment of this invention.

In a preferred embodiment of the present invention, the monitored detector position signal can be used as the basis of a negative feedback control loop to maintain the desired peel location during printing. A flowchart of the operation of a control loop for maintaining the peel position at the desired peel location during the printing process is shown in FIG. 8. The steps in FIG. 8 describe the process 500 for controlling the peel position in the desired location during the printing of a patch or section of a print. To start printing the patch, the web tension is first set to an appropriate level in Step 510 by adjusting a drive motor that rotates take-up roller 60. A system controller receives a signal output by the photodetector indicating a position of the web and adjusts the speed of the drive motor accordingly. The printing of the patch then begins in Step 520. A portion of the image to be printed is sent to the print head and printed in Step 530. After printing this portion of the patch, an the printer determines whether the patch printing is complete in Step 540. If the printing of the patch is not yet complete, the current peel position is then evaluated at step 550 to determine whether the patch is peeling at the desired location in Step 560. This is done by repetitively measuring the electrical output signal levels of the one or more photodetectors and computing the difference between the measured electrical output signal levels and the preferred position reference signal. If the peel position is consistent with the desired location, the next portion of the image is printed in Step 530. If the determination in Step 560 indicates that the web is not peeling in the desired location, the system controller adjusts the drive motor voltage for roller 60 appropriately, and the web tension is adjusted in Step 570 to shift the peel position closer to the desired location. The magnitude of the adjustment is based on the difference between the measured electrical output signal levels and the preferred position reference signal, which difference is repetitively measured. The process then repeats with printing the next portion of the image in Step 530. Eventually, when the print completion assessment in Step 540 indicates that the entire image of the patch has been printed, the patch printing process terminates in step 580.

The thermal printer includes a controller (not shown) which is used to control web tension by regulating roller motor velocities, collecting sensor data from printer functions including photodetectors D1 and D2. A comparator is used to determine the difference between the measured electrical output signal levels of the photodetector(s) and the preferred position reference signal, which can be stored in a controller memory. The comparator could be electronic or implemented as a software program in the controller. The tension on the donor web is then adjusted by the controller regulating roller motor velocities via a feedback loop based on the magnitude of the difference measured by the comparator. Motor speed control negative feedback loops are well known and are not described further. When the photodetectors sense that the donor web position 130 is closer to the photodetectors than a preferred position, a voltage or pulse width modulated duty cycle output to roller drive motors increases in response to the photodetectors, which increases the power to the roller motor controlling spool 60, for example, thereby tightening the donor web and bringing its peel position closer to point a of the peel position as described above. Conversely, when the photodetectors sense that the donor web position 130 is further from the photodetectors and closer to the ideal position a described above, then a voltage or pulse width modulated duty cycle output to roller motors decreases, which decreases the power to the roller motor controlling spool 60. A preferred embodiment of the present invention includes duty cycle control as described in U.S. Pat. No. 6,315,471, described above.

Figure 9:
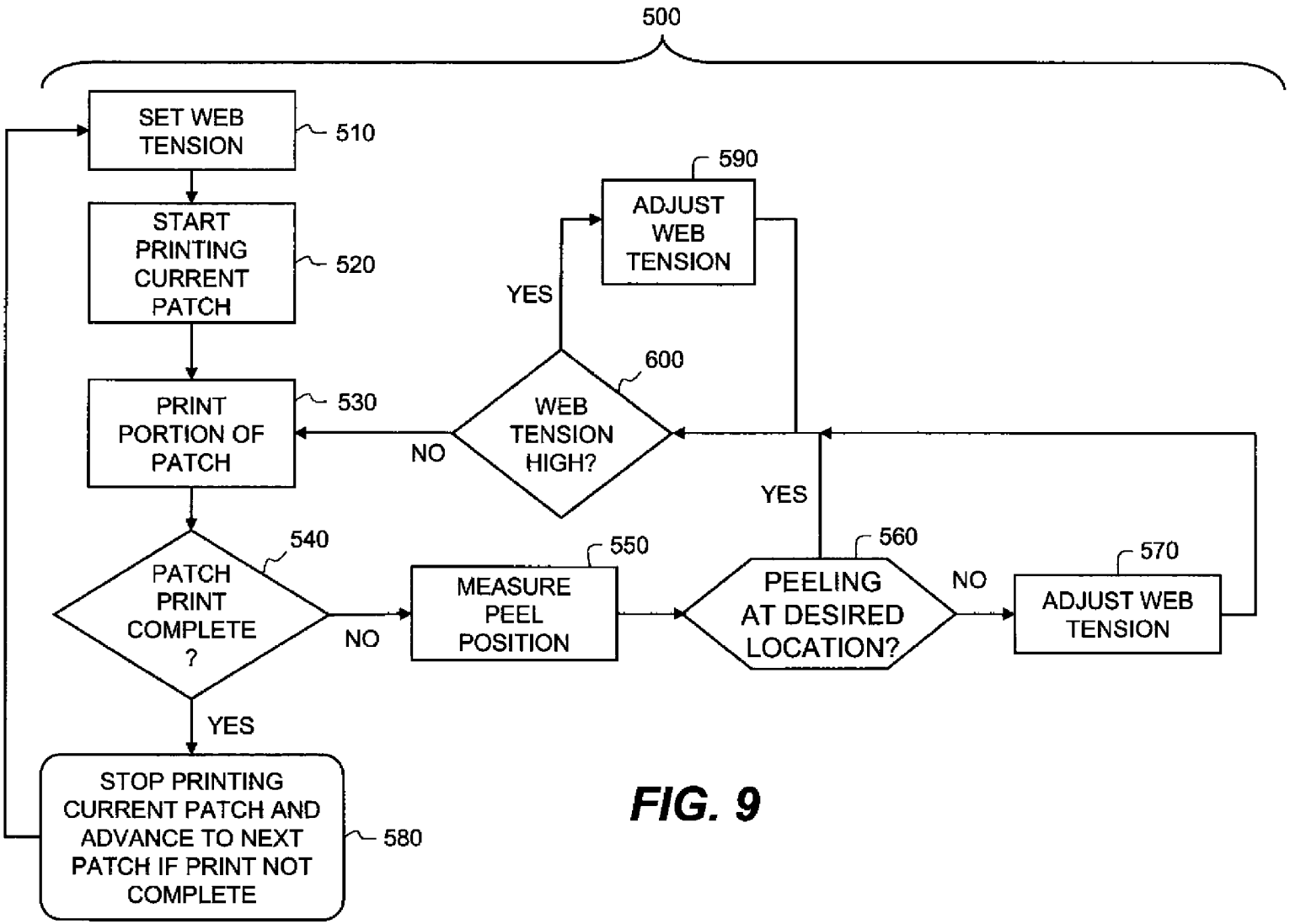
FIG. 9 shows a flow chart of a process for controlling the peel location position during the printing of a donor patch in accordance with an alternate embodiment of this invention.

FIG. 9 shows a flow chart of a process for controlling the peel position during the printing of a donor patch in accordance with an alternate preferred embodiment of the present invention. In addition to the steps in the control loop shown in FIG. 8, steps 590 and 600 are added which insure that the tension on the donor web at the peel bar is in a safe regime. This is determined by comparing the measured tension with a previously determined safe peel bar tension level. The safe level tension level would be determined during the set up of the thermal printer. If the web tension is determined to be above the safe level in step 600 it is adjusted downward in Step 590 towards the safe level.

Although the discussion of the optical probe 70 up to now has described an optical fiber probe, it is understood that the optical probe 70 may also comprise a pair of LED/photodetector pair sensors such as the Honeywell HO1160 series or HOA1397 reflective pair, Optek OPB700 series or Fairchild QRB1133 optical sensors. Reflectivity compensated optical fiber probes are commercially available from Philtec as part of their RC 100 fiber optic sensor or from MTI as part of their 2100 photonic sensor series.

Alternative Embodiments

The invention has been described in detail with particular reference to certain preferred embodiments thereof, but it will be understood that variations and modifications can be effected within the spirit and scope of the invention.

In particular, although the above discussions relate to maintaining the peel location in a printer, it is understood that the method and apparatus for maintaining a peel location applies to any peeling or separation process or device as applied between two or more substrates, sheets, or other media. The substrates may be bound together by adhesives, thermal processes or by any other method or technology. A substrate may exist naturally or by manufacture as an integrally formed single substrate that can be separated by peeling. Examples of such alternative peeling processes include solvent casting, compression rolling, thermal transfer and dry film photolithography and photoresist.

PARTS LIST

1 first color section
2 second color section
3 third color section
4 optional overcoat section
5 Thermal Printer
10 first web or dye donor web supply spool
20 Print head to Peel plate lamination distance
30 Print head
40 Peel bar
45 Load Cell
50 First web or dye donor web
60 first web take up spool
70 Optical probe
80 Motorized capstan roller
90 Pinch roller
100 Platen roller
110 Second Web or dye receiver sheet
120 Guide roller
130*a* Desired peel location
130*b* alternate peel location
130*c* alternate peel location
130*d* alternate peel location
140 Peel guide roller
150 Inner optical probe bundle
160 Outer optical probe bundle
170 Inner detection optical fiber
180 Illumination optical fiber
190 Outer detection optical fiber
200 Illumination cone
210 first distance plane
220 second distance plane
230 Outer fiber NA edge indicator
240 Outer fiber bundle reflected light edge indicator
250 Illumination cone edge indicator
260 Illumination fiber overlap edge indicator
270 Probe tip
280 First photodetector
290 Second photodetector
300 Light source
310 Light source optical fiber bundle
320 First detector optical fiber bundle
330 Second detector optical fiber bundle
400 Page printing flow chart
410 Step
420 Step
430 Step
440 Step
450 Step
460 Step
470 Step
480 Step
490 Step
500 Peel position control loop
510 Step
520 Step
530 Step
540 Step
550 Step
560 Step
570 Step
580 Step
590 Step
600 Step

The invention claimed is:

1. A system for maintaining a peel location for two webs, comprising:

a mounted optical probe having at least one light source and one or more photodetectors;

a reference signal corresponding to a desired peel location, the reference signal coupled to a comparator;

a measured electrical output signal corresponding to the one or more photodetectors;

a comparator for determining a difference between the measured electrical output signal and the reference signal and providing a correction signal based on the difference; and adjusting means for correcting the peel location according to the correction signal.

2. The system of claim 1 wherein the adjusting means includes a controller for controlling a speed of uptake of one of the two webs.

3. The system of claim 2 wherein the adjusting means further includes a drive motor coupled to the controller for rotating a take-up roller for taking up said one of the two webs.

4. The system of claim 1 wherein the measured electrical output signal is output by the one or more photodetectors based on a proximity of one of the two webs to the one or more photodetectors.

5. The system of claim 4 wherein the proximity of the one of the two webs is detected by shining light from the light source onto the one of the two webs and the photodetectors detecting an amount of light reflected by the one of the two webs.

6. The system of claim 5 wherein a magnitude of the measured electrical output signal corresponds to a magnitude of the detected amount of light and to a magnitude of the correction signal.

7. A thermal printer comprising:

print media for traveling through the thermal printer under control of rotating media rollers, the rotating media rollers controlling a slack of the media as it travels through the printer;

a drive motor for controlling a speed of rotation of at least one of the media rollers, thereby controlling an amount of the slack of the media; and a detector coupled to the drive motor for detecting the slack in the media and for outputting a signal indicating an excess of the slack in the media for enabling the drive motor to increase the speed of rotation of said at least one of the media rollers for reducing the excess of the slack, wherein the detector comprises a light source and at least one photodetector, the detector disposed to shine light onto the media and to detect an amount of light reflected from the media.

8. The thermal printer of claim 7, further comprising a circuit coupled to the detector for outputting the signal indicating the excess of the slack in response to the detected amount of light reflected from the media.

9. The thermal printer of claim 8, wherein the detector outputs an electrical signal based on the detected amount of light reflected from the media and the circuit includes a reference signal for comparing against the electrical signal before outputting the signal indicating the excess of the slack, the circuit outputting the signal indicating the excess of the slack if the reference signal and the electrical signal do not match.

10. The thermal printer of claim 7, wherein the slack in the media is detected after the media is peeled from a substrate.

11. The thermal printer of claim 10 further comprising a thermal printhead for adhering a portion of the media to the substrate before the media is peeled from the substrate.

12. A printer comprising:

a plurality of media rollers for controllably moving media, one of the media rollers having media rolled thereon, a second one of the media rollers for taking up used media, and a third one of the media rollers for guiding the media;

a receiver for adhering a portion of the media thereon;

receiver rollers for controllably moving the receiver;

a print head for selectively adhering the portion of the media onto the receiver;

a peel bar having an end near the adhered media for guiding a remaining portion of the media away from the receiver and for peeling the remaining portion of the media from the receiver at a peel location proximate the end near the adhered media; and a probe comprising a light source and at least one photodetector for shining light onto the peeled media and for detecting an amount of light reflected therefrom.

13. The printer of claim 12 further comprising a circuit coupled to the at least one photodetector for outputting an electrical signal corresponding to the detected amount of light.

14. The printer of claim 13 wherein a magnitude of the electrical signal corresponds to a magnitude of the detected amount of light.

15. The printer of claim 12 wherein the printhead includes a heater for heating selected portions of the media for adhering the selected portions of the media onto the receiver.

16. The printer of claim 14 wherein the magnitude of the detected amount of light corresponds to a distance between the media and the probe.

17. The printer of claim 13 further comprising a controller coupled to the circuit for adjusting the peel location based on a magnitude of the electrical signal.

18. The printer of claim 17 wherein the controller is further coupled to a drive motor that drives one of the media rollers for adjusting a rotation speed of said one of the media rollers in response to the magnitude of the electrical signal.

19. The printer of claim 18 wherein the rotation speed of said one of the media rollers controls a speed of movement of the media which, in turn, adjusts the peel location.

* * * * *